US006564117B1

(12) United States Patent
Chen et al.

(10) Patent No.: US 6,564,117 B1
(45) Date of Patent: May 13, 2003

(54) AUTOMATED OPTIMIZATION OF CROSS MACHINE DIRECTION PROFILE CONTROL PERFORMANCE FOR SHEET MAKING PROCESSES

(75) Inventors: Shih-Chin Chen, Dublin, OH (US); Peter Quang Tran, Dublin, OH (US)

(73) Assignee: ABB Automation Inc., Columbus, OH (US)

( * ) Notice: Subject to any disclaimer, the term of this patent is extended or adjusted under 35 U.S.C. 154(b) by 192 days.

(21) Appl. No.: 09/592,921

(22) Filed: Jun. 13, 2000

(51) Int. Cl.[7] ..... G06F 7/66
(52) U.S. Cl. ..... 700/129; 700/128
(58) Field of Search ..... 700/122, 127, 700/128, 129

(56) References Cited

U.S. PATENT DOCUMENTS

| | | | | |
|---|---|---|---|---|
| 5,122,963 A | * | 6/1992 | Chen | 700/129 |
| 5,170,357 A | | 12/1992 | Sasaki et al. | |
| 5,893,055 A | * | 4/1999 | Chen | 700/128 |
| 5,953,230 A | * | 9/1999 | Moore | 162/252 |
| 6,026,334 A | * | 2/2000 | Kayihan et al. | 700/28 |
| 6,086,237 A | * | 7/2000 | Gorinevsky et al. | 700/127 |
| 6,094,604 A | * | 7/2000 | Bucher et al. | 700/101 |
| 6,179,964 B1 | * | 1/2001 | Begemann et al. | 162/198 |
| 6,233,495 B1 | * | 5/2001 | Chen | 700/122 |
| 6,343,240 B1 | * | 1/2002 | Shakespeare et al. | 162/100 |

FOREIGN PATENT DOCUMENTS

EP 0 995 834 A1 4/2000

OTHER PUBLICATIONS

Sasaki, Takashi. "Cross Direction Control That Uses Optimizing Control Method and Fuzzy Logic." TAPPI Process Control, Electrical and Information Conference & ISA–PUPID 39th Annual Symposium, Mar. 26–30, 2000.

* cited by examiner

*Primary Examiner*—Leo Picard
*Assistant Examiner*—Alexander Kosowski
(74) *Attorney, Agent, or Firm*—Stevens & Showalter LLP

(57) ABSTRACT

The CD profile of a web of material being produced is monitored and controlled to update CD control settings on-line so that changes in the operation of a machine manufacturing the web can be corrected before significant profile deviations from a desired CD profile target result. Detected variances in the profile that satisfy a search criteria initiate searches for improved CD control settings. The CD control of the present application recognizes CD actuator mapping misalignments, determines improved CD control settings and applies the improved CD control settings to fine tune a CD controller and thereby improve upon or correct mapping misalignments. The CD control of the present application also recognizes non-smoothness of the setpoints of the CD actuators and controls the smoothness of the setpoints. Recognition and correction of either CD actuator mapping misalignments or CD actuator setpoint smoothness or both can be performed by the automated optimization of the present application.

23 Claims, 8 Drawing Sheets

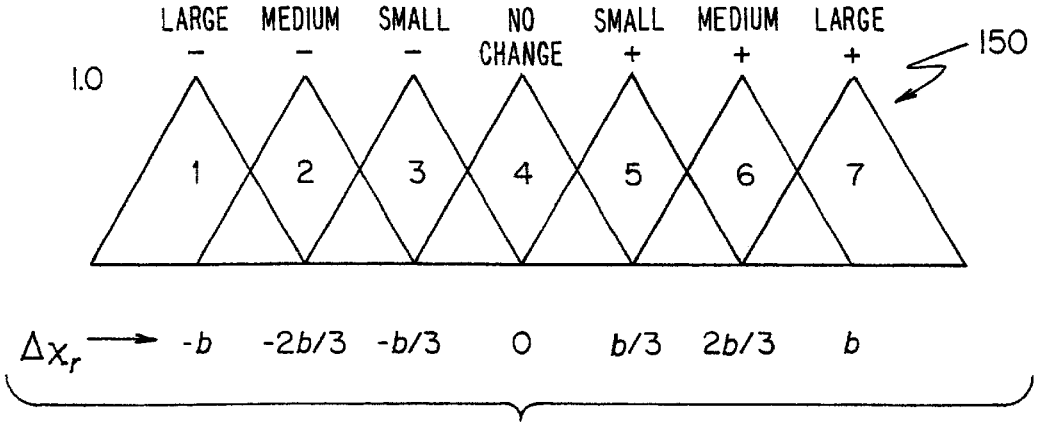

FIG. 8

| $\Delta x_u$ | | | | | | | | |
|---|---|---|---|---|---|---|---|---|
| | LARGE+ | LARGE+ | MEDIUM+ | SMALL+ | NO CHANGE | SMALL− | MEDIUM− | LARGE− |
| | MEDIUM+ | MEDIUM+ | MEDIUM+ | SMALL+ | NO CHANGE | SMALL− | MEDIUM− | MEDIUM− |
| | SMALL+ | SMALL+ | SMALL+ | SMALL+ | NO CHANGE | SMALL− | SMALL− | SMALL− |
| | NO CHANGE | NO CHANGE | NO CHANGE | NO CHANGE | NO CHANGE | NO CHANGE | NO CHANGE | NO CHANGE |
| | SMALL− | SMALL− | SMALL− | SMALL− | NO CHANGE | SMALL+ | SMALL+ | SMALL+ |
| | MEDIUM− | MEDIUM− | MEDIUM− | SMALL− | NO CHANGE | SMALL+ | MEDIUM+ | MEDIUM+ |
| | LARGE− | LARGE− | MEDIUM− | SMALL− | NO CHANGE | SMALL+ | MEDIUM+ | LARGE+ |
| | | LARGE− | MEDIUM− | SMALL− | NO CHANGE | SMALL+ | MEDIUM+ | LARGE+ |
| | | $\Delta_J$ | | | | | | |

FIG. 9

AUTOMATED OPTIMIZATION OF CROSS MACHINE DIRECTION PROFILE CONTROL PERFORMANCE FOR SHEET MAKING PROCESSES

BACKGROUND OF THE INVENTION

The present invention relates in general to web forming processes and, more particularly, to improved cross machine direction control of such processes. While the present invention can be applied to a variety of systems, it will be described herein with reference to a web forming machine used for making sheets of paper for which it particularly applicable and initially being utilized.

Uniformity of a property of a web of sheet material can be specified as variations in two perpendicular directions: the machine direction (MD) which is in the direction of web movement during production and cross machine direction (CD) which is perpendicular to the MD or across the web during production. Different sets of actuators are used to control the variations in each direction. CD variations appear in measurements known as CD profiles and are typically controlled by an array of actuators located side-by-side across the web width. For example, in a paper making machine an array of slice screws on a headbox or an array of white-water dilution valves distributed across a headbox are usually used to control the weight profiles of webs of paper produced by the machine.

Control schemes are used to control the CD actuators in order to reduce the variations at different CD locations across the web. For such schemes to succeed, it is crucial to apply control adjustments to the correct actuators, i.e., actuators that control areas of the web in which CD variations are to be reduced. Hence, the spatial relationship between the CD location of an actuator and the area of the profile the actuator influences is key to the implementation of a high-performance CD controller. The cross direction spatial relationship, between CD actuators and a CD profile, is known to those skilled in the art as "CD mapping". FIG. 1 shows an example of a CD mapping relationship 100 wherein bumps 102 made to actuators in an actuator array are reflected in the CD profile 106.

In many sheet-forming processes, the CD mapping relationship is not a linear function. For example, on a paper making machine, the CD mapping between the headbox slice screws and weight profile is particularly non-linear near the edges of the web due to the higher edge shrinkage. The nonlinear mapping relationship is a function of various machine conditions. The relationship cannot be easily represented with a fixed explicit function. Particularly in an ongoing web making operation where the CD mapping can change either gradually or abruptly, depending on the evolution of machine conditions.

Misalignment in the CD mapping can lead to deterioration in control performance. A typical symptom of mapping misalignment is the presence of sinusoidal variation patterns in both the CD profile and the actuator array. The appearance of the sinusoidal pattern is often referred to in the art as a "picket fence" pattern. The picket fence cycles that appear in both the CD profile and actuator arrays occur in the same region of the sheet and are usually of comparable spatial frequencies. The pattern is caused by the control actions being applied to the misaligned actuators.

Although the mapping misalignment can be corrected by adjusting the control setup, in the past such adjustment has required manual intervention. Dependent on the frequency of CD mapping changes, the number of manual interventions may be significant. At a minimum, manual intervention requires determination of how wide the sheet is at the forming end (location of the process where the actuator array is situated) and at the finishing end (location of the process where the CD profiles are measured). While these determinations may be sufficient to satisfy processes with very minimal nonlinear shrinkage, for processes with extreme non-linear shrinkage, the scope of manual intervention may require perturbing the actuator array, at multiple locations, to determine the mapping relationship between the actuators and the CD profile. Such perturbations are typically performed with the CD control system turned off. Additionally, only a few actuators, spaced sufficiently far apart, are normally perturbed at a given time to ensure separation of the response locations in the CD profile. For a CD control system with a large actuator array, such perturbations or bumps may consume an extended period of production on the process.

It is also possible to control the smoothness of the setpoints of the actuator array, i.e., to restrict the setpoint differences between adjacent actuators in the actuator array, to reduce the amplitude of the cycles. Control of smoothness is also a mechanism for making the CD control system more robust for modeling uncertainty under different process conditions and the presence of uncontrollable variations in the CD profile.

Accordingly, there is a need in the art for an improved CD control for sheet making processes that can overcome changes in the mapping relationships between CD actuators and the corresponding CD profile of the web that they control. The control arrangement would correct the mappings without interruption of the CD control system and preferably would also control the smoothness of the setpoints of the actuator array instead of or in addition to corrections of the mappings.

SUMMARY OF THE INVENTION

This need is met by the invention of the present application wherein the CD profile of a web of material being produced is monitored and controlled to update CD control settings on-line so that changes in the operation of a machine manufacturing the web can be corrected before significant profile disturbances result. More particularly, detected variations in the profile that satisfy a search criteria, for example standard deviation between about 0.25% and about 0.75% of a web target or specification value, trigger searches for improved CD control settings. One aspect of the present invention recognizes CD actuator mapping misalignment, determines improved CD actuator control settings and applies the improved CD actuator control settings to fine tune a CD controller and thereby improve upon or correct the misalignment so that the CD controller will have improved and consistent long-term performance. Another aspect of the present invention recognizes abnormality in the smoothness of the setpoints of the CD actuators and controls the smoothness of the setpoints to again improve upon or correct such errors so that the CD controller will have improved and consistent long-term performance. The present invention encompasses the recognition and correction of either CD actuator mismatches or the CD actuator setpoint smoothness or both.

Features and advantages of the invention will be apparent from the following description, the accompanying drawings and the appended claims.

BRIEF DESCRIPTION OF THE DRAWINGS

FIG. 8 shows the output membership function for the fuzzy system of FIG. 6;

FIG. 9 shows the system rule set for the fuzzy system of FIG. 6;

DETAILED DESCRIPTION OF THE INVENTION

Figure 1:
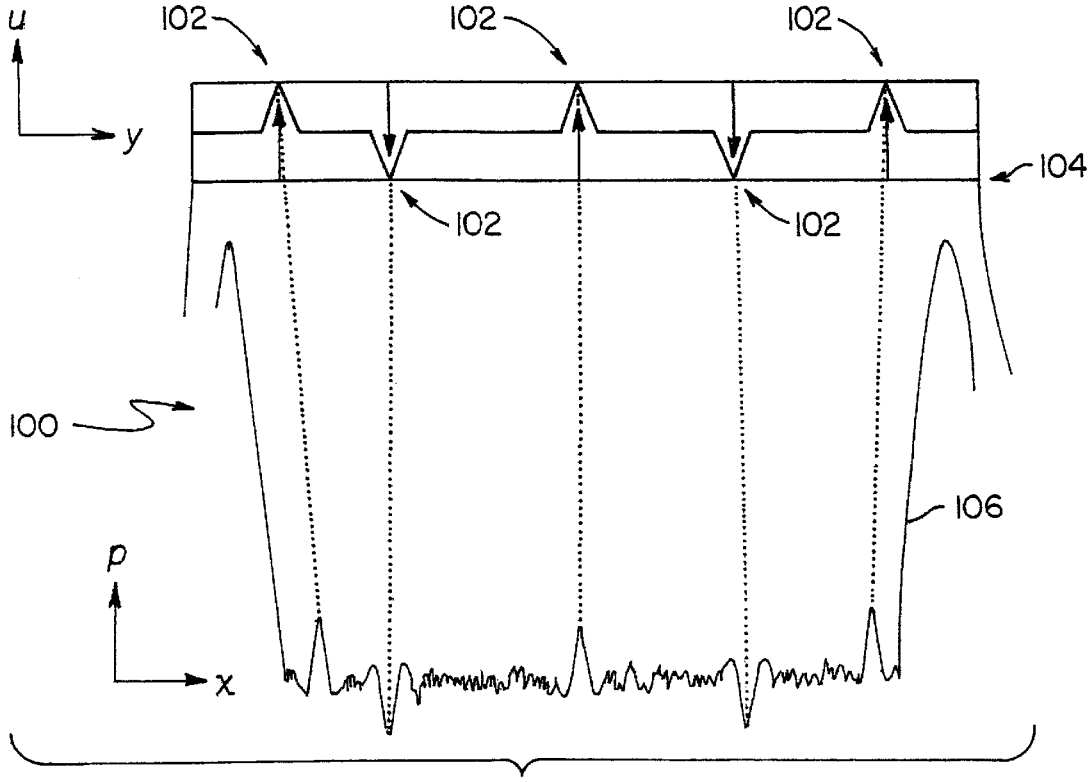
FIG. 1 shows an example of CD mapping between CD actuators and their corresponding regions of influence in a CD profile.
Figure 2:
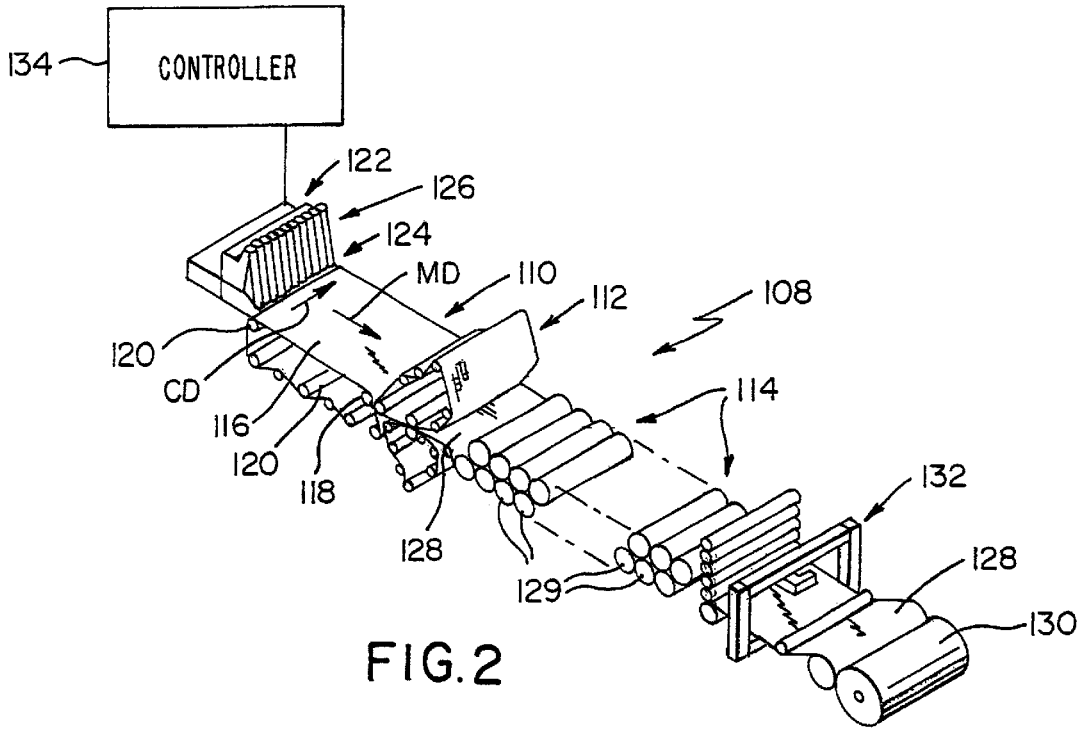
FIG. 2 is a perspective view of a paper making machine operable in accordance with the present invention.

The invention of the present application will now be described with reference to the drawings wherein FIG. 2 schematically illustrates a paper making machine 108 having a Fourdrinier wire section 110, a press section 112, a dryer section 114 having its midsection broken away to indicate that other web processing equipment, such as a sizing section, additional dryer sections and other equipment well known to those skilled in the art, may be included within the machine 108.

The Fourdrinier wire section 110 comprises an endless wire belt 116 wound around a drive roller 118 and a plurality of guide rollers 120 properly arranged relative to the drive roller 118. The drive roller 118 is driven for rotation by an appropriate drive mechanism (not shown) so that the upper side of the endless wire belt 116 moves in the direction of the arrow labeled MD that indicates the machine direction for the process. A headbox 122 receives pulp slurry, i.e. paper stock, that is discharged through a slice lip 124, controlled using a plurality of CD actuators 126, slice screws as illustrated in FIG. 2, onto the upper side of the endless wire belt 116. The pulp slurry is drained of water on the endless wire belt 116 to form a web 128 of paper. The water drained from the pulp slurry to form the web 128 is called white water that contains pulp in a low concentration and is collected under the Fourdrinier wire section 110 and recirculated in the machine 108 in a well known manner.

The web 128 so formed is further drained of water in the press section 112 and is delivered to the dryer section 114. The dryer section 114 comprises a plurality of steam-heated drums 129. The web 128 may be processed by other well known equipment located in the MD along the process and is ultimately taken up by a web roll 130. Equipment for sensing characteristics of the web 128, illustrated as a scanning sensor 132 in FIG. 2, is located substantially adjacent to the web roll 130. It is noted that other forms of sensing equipment can be used in the present invention including stationary sensing equipment for measuring part or the entire web 128 and that sensing equipment can be positioned at other locations along the web 128.

As previously mentioned, misalignment of the CD mapping in the machine 108 can lead to deterioration in CD control performance resulting, for example, in sinusoidal patterns often referred to as "picket fence" patterns. Prior to the invention of the present application, correction of mapping misalignment has required manual adjustment of the control settings that can consume an extended period of production and may require disabling the CD control system during the correction.

One aspect of the present invention overcomes this problem by recognizing mapping misalignment, determining improved CD control settings and applying the improved CD control settings to fine tune a CD controller and thereby improve upon or correct the misalignment so that the CD controller will have improved and consistent long-term performance. The CD control of the present application is preferably included within a controller 134 for the paper making machine 108, although it can be included within a separate controller (not shown) coupled to the controller 134. The following questions are addressed herein. What regions of the CD profile exhibit mapping misalignment? How should the impact on the paper making machine 108 be measured as a result of new control settings? And, how should the CD control settings be adjusted to correct the mapping misalignment and achieve improved performance? In answer, the present invention introduces an automated optimization technique that determines the locations of mapping misalignment, establishes an effective performance indicator to measure the impact of mapping misalignment, and applies a searching technique, embodied in fuzzy logic for the illustrated embodiment, to search for and identify an improved CD mapping and to apply the improved CD mapping to the machine 108.

Another aspect of the automated optimization of the present application enables a CD control system to maintain improved long-term control performance even though CD mapping misalignment occurs randomly. Long-term control performance is automatically adjusted without manual intervention and without suspension of the CD control system. Optimization is based on specific performance indicators and, in the illustrated embodiment, on a set of fuzzy rules with a fuzzy search engine executing actions in accordance with the fuzzy rule set. The present optimization technique automatically searches for an improved CD mapping and/or smoothness changes for use as continuing CD control. Thus, operators are provided with hands-free automation and long-term consistent CD control performance.

The automated optimization of the present application compliments existing CD control systems by monitoring the CD profile as the web is produced and adjusting the control settings to improve the long-term performance of the CD control system. Automated searches can be performed periodically or triggered when measured web properties exceed selected thresholds (for example when the standard deviation of the overall CD profile is greater than about 0.5% of the process target or some other value within a range of about 0.25% to about 0.75%). Each time a search is run, the search engine can inhibit further searches for a period of time. Other searching and scheduling techniques will be apparent to those skilled in the art in view of the disclosure of the present application. Since the optimization search relies on operation of the CD control system, it is apparent that the CD control system cannot be interrupted or suspended during the optimization search.

With the foregoing overview of the invention of the present application, a more detailed disclosure will now be provided. CD control adjustments made by a CD control system which has CD actuator mapping misalignments results in increased variability in the CD profile. Thus, in accordance one aspect of the present invention, the automated optimization determines the regions where CD actuators have mapping misalignment so that the misalignment can be corrected before the CD profile variability becomes a problem. The CD mapping misalignment regions are regions that exhibit high local variations. The CD misaligned regions are determined by transforming the CD profile into a CD variance profile, selecting the highest variation locations from the CD variance profile and mapping the highest variation locations into actuator regions. A variance profile at time t is defined as a profile of windowed variance at each CD location x of CD profile p(x,t) at time t.

Let vector p(x,t) represent the full-width CD profile of a sheet property at time t. The variable x is a vector representing the contiguous CD position for the full-width web or sheet of paper. The elements of x are often referred to as the CD profile databox numbers or lane numbers. The element, $p(x_i,t)$, of profile p(x,t) represents the sheet property at CD databox $x_i$ and at time t. The vector e(x,t) represents the full-width CD high-pass filtered profile at time t, as defined in Equation (1).

$$e(x,t)=p(x,t)-Fp(x,t) \tag{1}$$

Each element, $v(x_i,t)$ of a variance profile v(x,t) is defined as the variance of a windowed variation of CD profile e(x,t) around $e(x_i,t)$. The variance profile v(x,t) can be given by Equation (2).

$$s(x,t)=\lfloor e^2(x_i,t)\rfloor$$
$$v(x,t)=Ws(x,t) \tag{2}$$

where s(x,t)is a column vector

In Equations (1) and (2), both F and W are band-diagonal square matrices. The non-zero band-diagonal elements of F define a two-sided low-pass filter window and the non-zero band-diagonal elements of W define a weighted mean. For a general case, the nonzero band-diagonal elements in W do not have to be equally-weighted.

If the element $w_{ij}$ in the matrix W is defined by Equation (3) and r is a single-sided weighting length, then $v(x_i,t)$ is an equally-weighted squared mean of 2r+1 points of e(x,t) around $e(x_i,t)$. The resulting vector v(x,t), is called a "variance profile" of the CD profile p(x,t).

$$w_{ij} = \frac{1}{\min(m,\ i+r)-\max(1,\ i-r)+1}, \quad \text{if } \max(1,\ i-r) \le j \le \min(m,\ i+r); \quad = 0, \ \text{otherwise} \tag{3}$$

where min(a,b) and max(a,b) mean the minimum and maximum values between a and b, respectively.

From the CD variance profile v(x,t), a recursive method of selecting the highest variance regions in the CD profile is derived. On the h-th iteration, the method consists of the following steps:

1. Selecting the databox x*(h), where v(x*(h),t) is the largest among all elements of v(x,t).
2. Adding the selected x*(h) to an ordered set X $$X=\{x^*(1),x^*(2),x^*(3),\ldots x^*(h)\}$$

3. Zeroing all entries in v(x,t) that are within l elements to either side of x*(h) (subject to the boundary of 1 and m). The typical minimum length l is specified to be equal to twice the weighting window length r (2r), of the weighting matrix W.

$$x^l(h)=\max(1,x^*(h)-l)$$
$$x^u(h)=\min(m,x^*(h)+l)$$
$$[v(x^l(h),t)\ldots v(x^u(h),t)]=[0\ldots 0]_{l\times[x^u(h)-x^l(h)+1]} \tag{4}$$

4. Iterate back to 1 or terminate the described process if all elements of v(x,t) are finally zeroed. Once the process is terminated at the h-th iteration, the ordered set X contains a total of h elements.

In the final stage of determining potential actuator mapping misalignment regions, the selected databoxes in the ordered set X are mapped into actuator indices based on the current CD mapping relationship where the current CD mapping relationship is defined by two vectors, $b^l(y)$ and $b^u(y)$. The variable $y=[y_s]$ is a vector of actuator indices where $y_s$ is referred to as the s-th actuator. The elements $b^l(y_s)$ and $b^u(y_s)$, from the vectors $b^l(y)$ and $b^u(y)$, represent the lower and upper bounds of the s-th actuator mapping expressed in databox units, respectively.

Let k be the index of element x* in the ordered set X, i.e. $x^*(k)\epsilon X$ where $1\leqq k\leqq h$, the actuator index y*(k) associated with x*(k) is found by searching each element of y so that x*(k) falls between the values of $b^l(y^*(k))$ and $b^u(y^*(k))$. The ordered set Y of y*(k) is obtained from the equation:

$$Y=\{y^*(k)|\text{where } y^*(k) \text{ satisfies } b^l(y^*(k))\leqq x^*(k)\leqq b^u(y^*(k)) \text{ for each } x^*(k)\epsilon X\} \tag{5}$$

Figure 3:
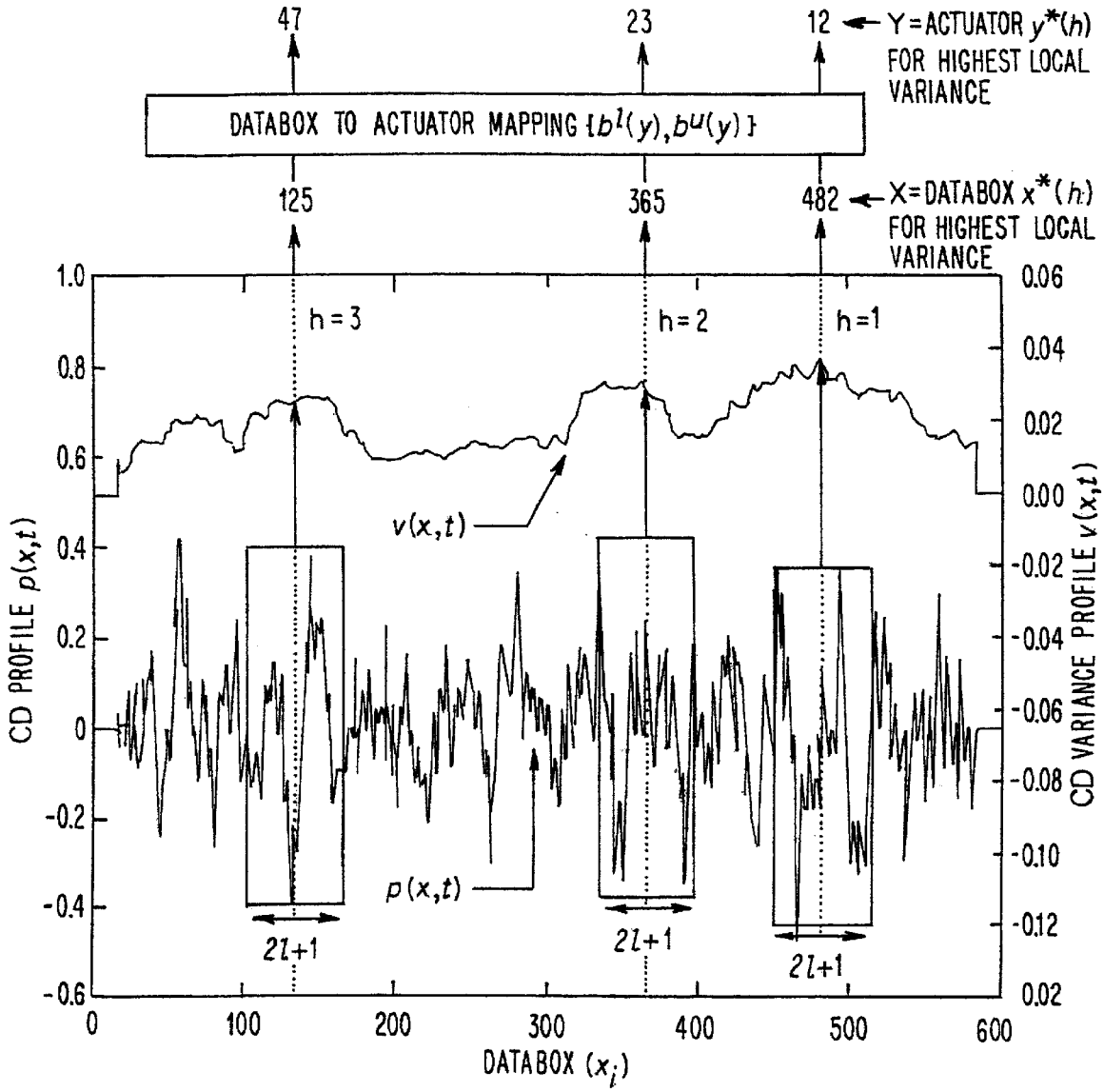
FIG. 3 illustrates selection of potential CD profile mapping misalignment regions and conversion into actuator positions in accordance with the present invention.

The above selection of the regions that have potential CD profile mapping misalignment is illustrated in FIG. 3. Once these regions have been identified, a search for an improved CD mapping is performed. In the present application, a performance indicator is established for each actuator region to evaluate the effectiveness of changes of the actuator mapping alignment. The performance indicators are expressed as quadratic functions of CD profile and actuator setpoints around the regions identified in sets X and Y respectively.

As previously defined, the vector e(x,t) represents the full-width CD high-pass filtered profile, at time t. Additionally, let us use the vector u(y,t) to represent the setpoints of the actuator array, at time t. Also, as previously defined, the variable y is an actuator index vector. With the objective of optimizing the local performance of the CD profile, it is essential to evaluate only a local region of the vectors e(x,t) and u(y,t). To establish a local region of e(x,t) and u(y,t), the following definitions are applied to the development of the mapping performance indicator:

- $a_{kd}=\{s|$ all actuator indices s satisfies $\max(1,y^*(k)-d)\leqq s\leqq \min(n,y^*(k)+d)\}$ is a range of actuators around the y*(k)-th actuator, where d is the actuator range around the y*(k)-th actuator and n is the total number of actuators.
- $b^u(y^*(k))$ is the upper bound of the y*(k)-th actuator mapping, expressed in databox numbers
- $b^l(y^*(k))$ is the lower bound of the y*(k)-th actuator mapping, expressed in databox numbers $b_{kd}$={i| all databox indices i satisfies $b^l(y^*(k)-d) \leqq i \leqq b^u(y^*(k)+d)$} is a range of databox numbers corresponding to the range of actuators in $a_{kd}$ $c_k$ is the center of response for the y*(k)-th actuator, expressed in databox numbers With the above variable definitions, the local segment of e(x,t) and u(y,t) associated with the window around the y*(k)-th actuator can be defined as $u_{kd}$=[u($y_s$,t)]where $s \epsilon a_{kd}$ is the local segment of actuator setpoint array corresponding to the range of actuators in $a_{kd}$, $u_{kd}$ is a column vector.

$e_{kd}$=[e($x_i$,t)] where $i \epsilon b_{kd}$ is the local segment of CD high-pass profile, e(x,t), corresponding to the range of databoxes in $b_{kd}$, $e_{kd}$ is a column vector.

and the performance indicator for mapping optimization can be expressed as the quadratic function $J_k$ $$J_k(e_{kd},u_{kd},c_k)=e_{kd}^T Q_{kd}^T Q_{kd} e_{kd}+\lambda_{kd} u_{kd}^T R_{kd}^T R_{kd} u_{kd} \tag{6}$$

In the performance indicator of equation (6), $Q_{kd}$ and $R_{kd}$ are weighting matrices and the variable $\lambda_{kd}$ is a weighting factor. For mapping optimization, the center of response of the y*(k)-th actuator and its adjacent actuators are adjusted. Typically, the parameter search adjusts $c_k$ directly. The centers of response of actuators adjacent to the y*(k)-th actuator are linearly interpolated between y*(k−1) and y*(k), and between y*(k) and y*(k+1). Additionally, the range parameter d is typically common for any actuator y*(k) being optimized. Therefore, without loss of generality, there is no confusion by eliminating the subscript d from equation (6). With this simplification, the performance indicator of equation (6) can be written as:

$$J_k(e_k,u_k,c_k)=e_k^T Q_k^T Q_k e_k+\lambda_k u_k^T R_k^T R_k u_k \tag{7}$$

In the performance indicator of equation (7), if $$\lambda_k = 0 \tag{8}$$

$$Q_k = \frac{I_{l_k \times l_k}}{\sqrt{l_k}}, \quad \text{where } l_k = \text{length of } e_k$$

where $I_{l_k \times l_k}$ is the identity matrix, then $J_k$ represents the localized variance of the CD high-pass filtered profile e(x,t), over the range specified by $e_k$. If $$\lambda_k \neq 0 \tag{9}$$

$$R_k = \begin{bmatrix} -1 & 1 & 0 & \cdots & 0 \\ 1 & -2 & 1 & \ddots & \vdots \\ 0 & \ddots & \ddots & \ddots & 0 \\ \vdots & \ddots & 1 & -2 & 1 \\ 0 & \cdots & 0 & 1 & -1 \end{bmatrix}_{(2d+1)\times(2d+1)}$$

$$Q_k = [q_j]_{l_k \times l_k}$$

where $q_j$ is a column vector in the j-th column which specifies a band-pass filter symmetric about the j-th element $q_{jj}$ in $q_j$, then $J_k$ represents a measure of a localized streak pattern for both e(x,t) and u(y,t). In this case, since $J_k$ reflects the severity of the localized streak pattern, $J_k$ could be called the "streak index at k", or simply a "streak index".

In the most general case, both the $Q_k$ and $R_k$ matrices are constructed as band-pass matrices, to isolate a specific frequency band of variations in the CD profile and actuator setpoint array, respectively. For the general case, the term "streak index" can mean streak patterns at different frequency bands.

Figure 4:
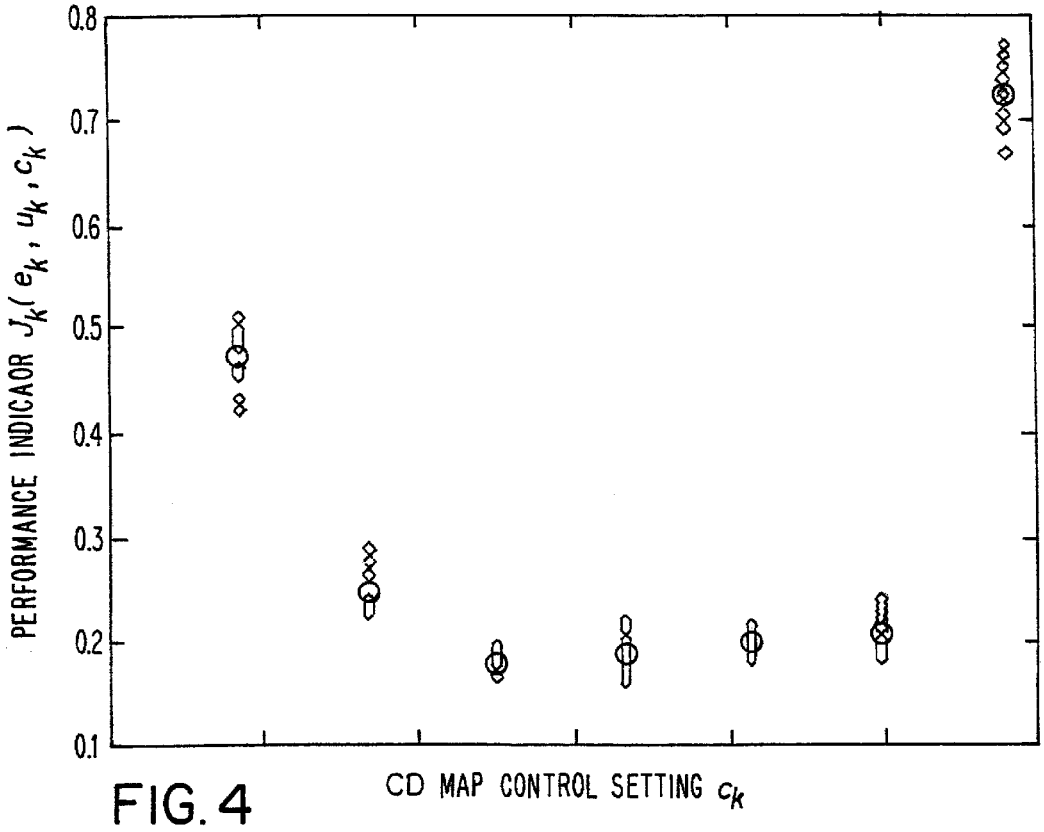
FIG. 4 illustrates the relationship of the performance indicator $J_k$ to the CD mapping search parameter $c_k$ (center of response for the y*(k)-th actuator mapping) in accordance with the present invention.

Applying the quadratic performance indicator defined in equation (7) to process data, the relationship of the performance indicator $J_k$ to the CD control setting $c_k$ is displayed in FIG. 4. Given the performance indicator of equation (7) and the result illustrated in FIG. 4, the mapping optimization for the y*(k)-th actuator can be stated as:

$$c_k^{opt} = \underset{c_k \in [1,m]}{\arg\min}\{J_k(e_k, u_k, c_k)\} \tag{10}$$

where the notation

"$\underset{\omega \in \Omega}{\arg\min}\{J\}$"

means "the argument that minimizes the function J subject to the argument ω that is an element of Ω".

The other objective of the present application, i.e., optimizing or improving the long-term performance of a CD control system, is to minimize or reduce the variance of the full-width CD profile. Similar to local optimization, the performance indicator for the full-width performance is characterized by both the CD profile and the actuator setpoint array at a given value of a full-width optimization parameter. However, this performance indicator is defined for the entire CD profile and the entire actuator setpoint array.

The performance indicator for the full-width optimization can be expressed as the quadratic function J:

$$J(p,u,\beta)=p^T Q^T Q p+\lambda u^T R^T R u \tag{11}$$

In the performance indicator of equation (11), Q and R are weighting matrices and λ is a factor used to adjust the weighting of the actuator setpoint array. In equation (11), if $$\lambda = 0, \tag{12}$$

$$Q = \frac{I_{m\times m}}{\sqrt{m}}, \quad m = \text{length of } p,$$

where $I_{m\times m}$ is the identity matrix, then J represents the variance of the entire CD profile p(x,t). If $$\lambda = \beta, \tag{13}$$

$$R = \begin{bmatrix} -1 & 1 & 0 & \cdots & 0 \\ 1 & -2 & 1 & \ddots & \vdots \\ 0 & \ddots & \ddots & \ddots & 0 \\ \vdots & \ddots & 1 & -2 & 1 \\ 0 & \cdots & 0 & 1 & -1 \end{bmatrix}_{n\times n},$$

$$Q = [q_j]_{m\times m},$$

where $q_j$ is a column vector in the j-th column which specifies a band-pass filter symmetric about the j-th element $q_{jj}$ in $q_j$ and matches the frequency band captured by the matrix R. For this case, the variable β serves the function of a weighting factor for the global smoothing of the actuator setpoint array.

Figure 5:
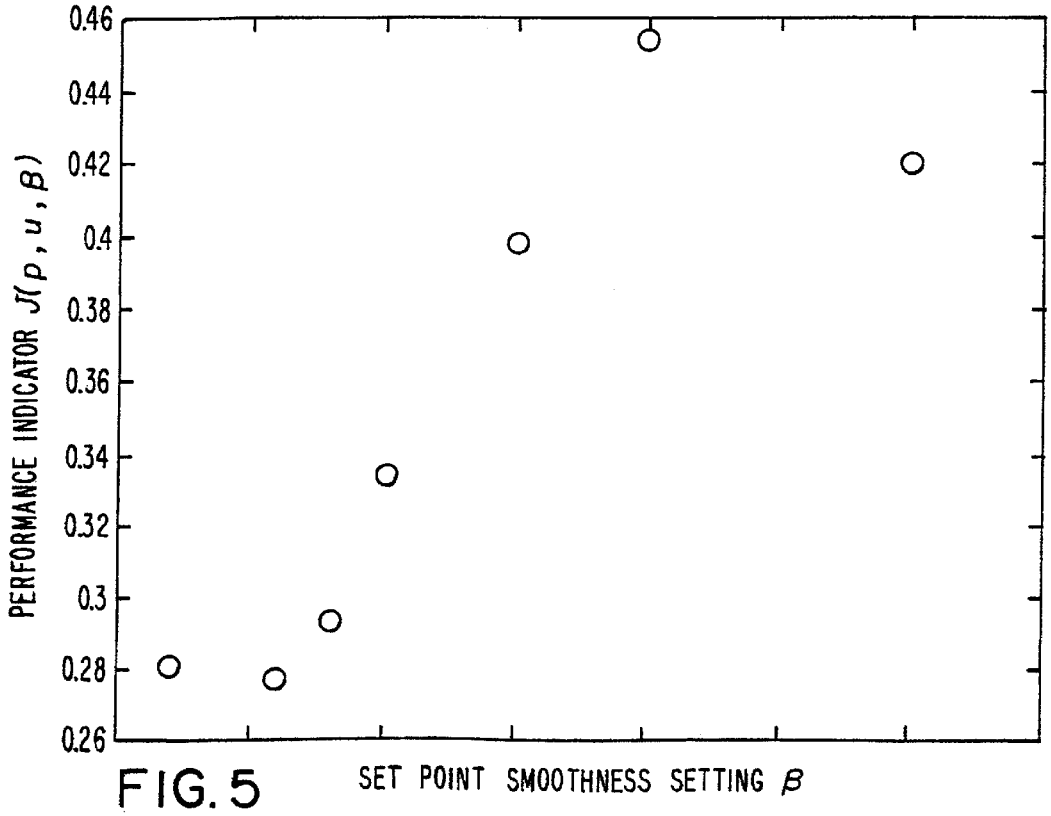
FIG. 5 illustrates the relationship of the performance indicator to the smoothness setting for global smoothing in accordance with the present invention.

Applying the quadratic function defined in equation (11) to process data, the relationship of the performance indicator J to the global smoothing β is displayed in FIG. 5. Given the performance indicator of equation (11) and the result illustrated in FIG. 5, the objective for full-width performance optimization can be stated as:

$$\beta^{opt} = \arg\min_{\beta \in \mathbb{R}^+}\{J(p, u, \beta)\} \quad (14)$$

A number of known optimization methods can be used in the present invention to optimize the performance indicators, including genetic algorithm and the gradient method. The gradient method is used in the illustrated embodiment of the performance indicators of Equations (7) and (11). As is well known, the gradient method is an iterative technique that adjusts the value of a parameter to improve the value of the performance indicator on successive iterations. For minimization, the parameter is adjusted to reduce the value of the performance indicator. The basis equation for this optimization method is given in Equation (15).

$$\chi(t+T)=\chi(t)+\alpha(t)\delta(t) \quad (15)$$

The references t and t+T are used to denote values at the current and the next execution cycles of the basis equation, respectively. $\chi$ is the parameter being adjusted to optimize the performance indicator. $\alpha$ is a positive adjustment magnitude used for changing the current value of $\chi$. $\delta$ is the adjustment direction, with values of positive one (+1), negative one (−1) and zero (0), for applying the magnitude $\alpha$ to the current value of $\chi$. The $\delta$ values of positive one (+1), negative one (−1) and zero (0) translate to increasing, decreasing and not changing the current value of $\chi$ by the magnitude $\alpha$, respectively.

When applying the gradient method to minimize a performance indicator J, nine generalized adjustment rules can be stated for the parameter $\chi$.

1. If the change in parameter $\chi$ is positive ($\Delta\chi>0$) and the change in performance indicator J is positive ($\Delta J>0$), then the current value $\chi$ is decreased by $\alpha$.
2. If the change in parameter $\chi$ is positive ($\Delta\chi>0$) and the change in performance indicator J is negative ($\Delta J<0$), then the current value $\chi$ is increased by $\alpha$.
3. If the change in parameter $\chi$ is negative ($\Delta\chi<0$) and the change in performance indicator J is negative ($\Delta J<0$), then the current value $\chi$ is decreased by $\alpha$.
4. If the change in parameter $\chi$ is negative ($\Delta\chi<0$) and the change in performance indicator J is positive ($\Delta J>0$), then the current value $\chi$ is increased by $\alpha$.
5. If the change in parameter $\chi$ is positive ($\Delta\chi>0$) and the performance indicator J is not changed ($\Delta J=0$), then the current value $\chi$ is not changed.
6. If the change in parameter $\chi$ is negative ($\Delta\chi<0$) and the performance indicator J is not changed ($\Delta J=0$), then the current value $\chi$ is not changed.
7. If the parameter $\chi$ is not changed ($\Delta\chi=0$) and the change in performance indicator J is negative ($\Delta J<0$), then the current value $\chi$ is not changed.
8. If the parameter $\chi$ is not changed ($\Delta\chi=0$) and the change in performance indicator J is positive ($\Delta J>0$), then the current value $\chi$ is not changed.
9. If the parameter $\chi$ is not changed ($\Delta\chi=0$) and the performance indicator J is not changed ($\Delta J=0$), then the current value $\chi$ is not changed.

For the case of CD actuator mapping optimization, $\chi$ is the CD map setting $c_k$ (center of response for the y*(h) th actuator mapping). For the case of full-width optimization, $\chi$ is the setpoint global smoothness setting $\beta$. The mathematical definition of $\delta$, $\Delta\chi$ and $\Delta J$ is given in Equation (16). The references to t and t−T are used to denote values at the current and the previous execution cycles of the basis equation, respectively.

$$\delta(t)=\text{sign of } (-\Delta\chi\Delta J)$$

$$\Delta\chi=\chi(t)-\chi(t-T)$$

For mapping:

$$\Delta J=J_k(p_k(t),u_k(t),c_k(t))-J_k(p_k(t-T),u_k(t-T),c_k(t-T))$$

For full-width performance:

$$\Delta J=J(p(t),u(t),\beta(t))-J(p(t-T),u(t-T),\beta(t-T)) \quad (16)$$

Given the stated rules, in the illustrated embodiment, adjusting the value of $\chi$ is achieved by a fuzzy logic system with two inputs and one output. The fuzzy logic system provides variable adjustment magnitudes and nonlinear adjustment for the optimum value of $\chi$. For this system, the input and output linguistic variables are:

Input Linguistic Variables $\Delta J$: "change in performance indicator J"

$\Delta\chi_a$: "actual change in control setting $\chi$" ($c_k$ or $\beta$)

Output Linguistic Variable $\Delta\chi_r$: "requested change in control setting $\chi$" ($c_k$ or $\beta$)

Figure 6:
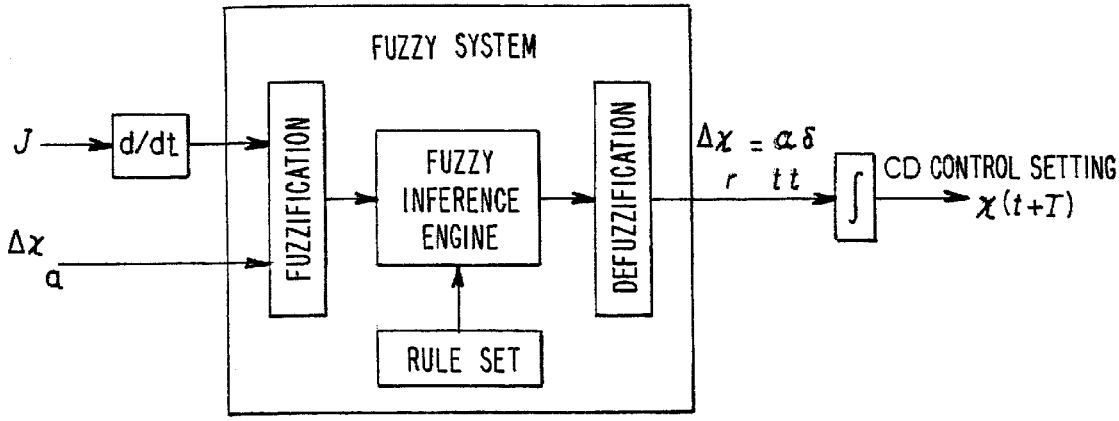
FIG. 6 is a block diagram of a fuzzy system update engine that can be used in the present invention.
Figure 7:
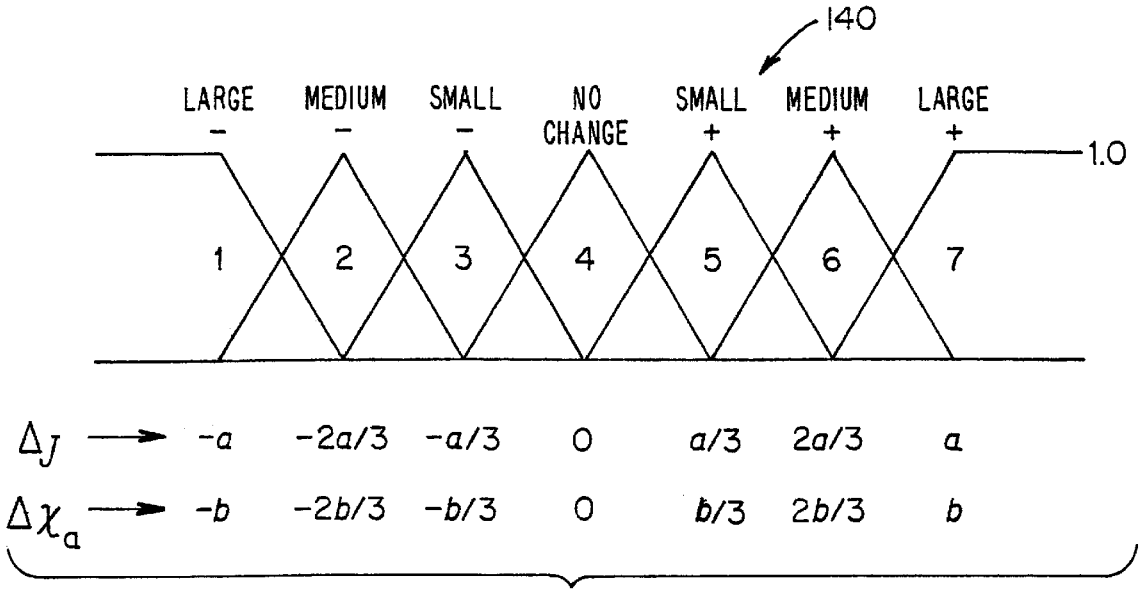
FIG. 7 shows the input membership function for the fuzzy system of FIG. 6.

The fuzzy system used to model the gradient method is illustrated in FIG. 6. Seven coefficient triangular membership functions are used to define the linguistic values of the inputs and output, see FIGS. 7 and 8 which illustrate the selection of the membership functions and the assignment of the linguistic values. FIG. 7 shows the input membership function 140 and FIG. 8 shows the output membership function 150. The center coefficients (coefficient #4) of the membership functions 140 and 150 are set to zero to capture the notion of "no change". Coefficients 1 through 3 of membership function 140 are set to negative values to capture the notion of "negative" changes in $\chi$ and J; while coefficients 5 through 7 are set to positive values to capture the notion of "positive" changes in $\chi$ and J. Coefficients 1 through 3 of membership. function 150 are set to negative values to capture the notion of "decrease" in the value of $\chi$; while coefficients 5 through 7 are set to positive values to capture the notion of "increase" in the value of $\chi$. The absolute magnitudes of the non-zero coefficients are scaled to achieve the desired resolution for the inputs and output. Since the change in $\chi$ ($c_k$ or $\beta$ in the invention of the present application) is both an input and an output linguistic variable, the same linguistic values are used for $\Delta\chi_a$ (actual change) and $\Delta\chi_r$ (requested change) membership functions.

Figure 10:
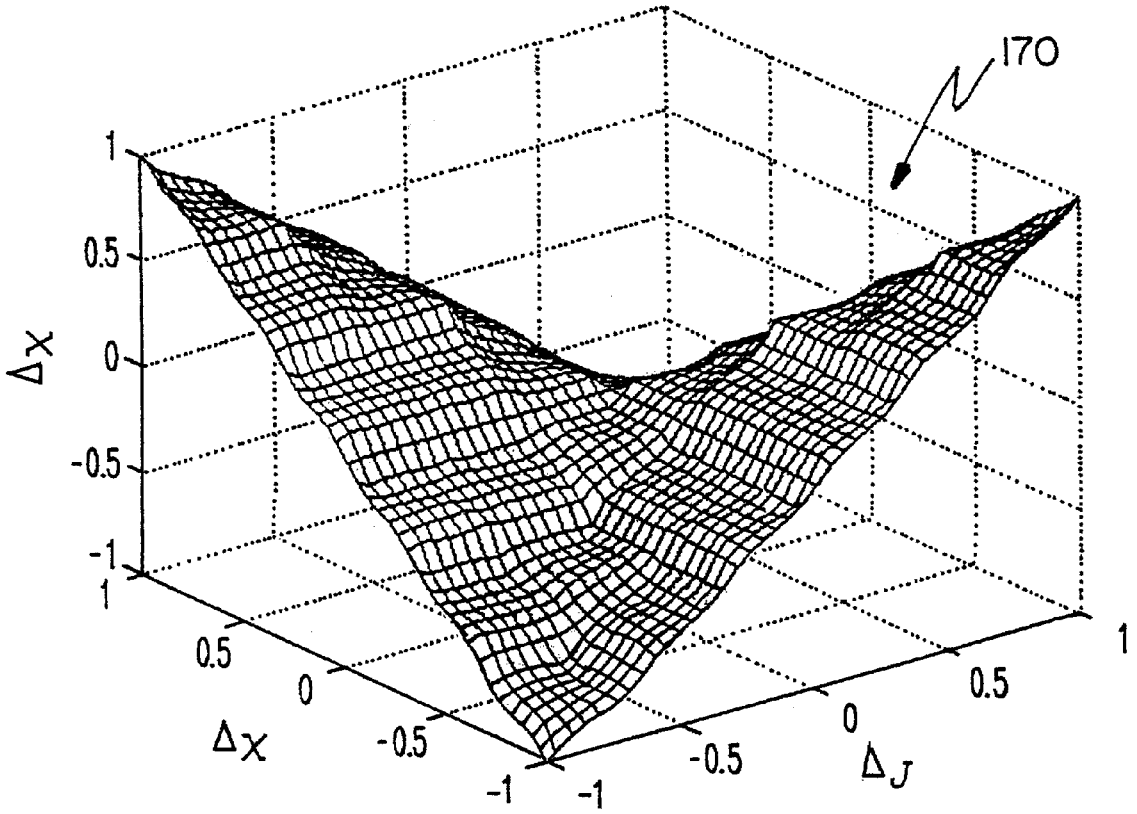
FIG. 10 shows the surface for the rule set of FIG. 9.
Figure 11:
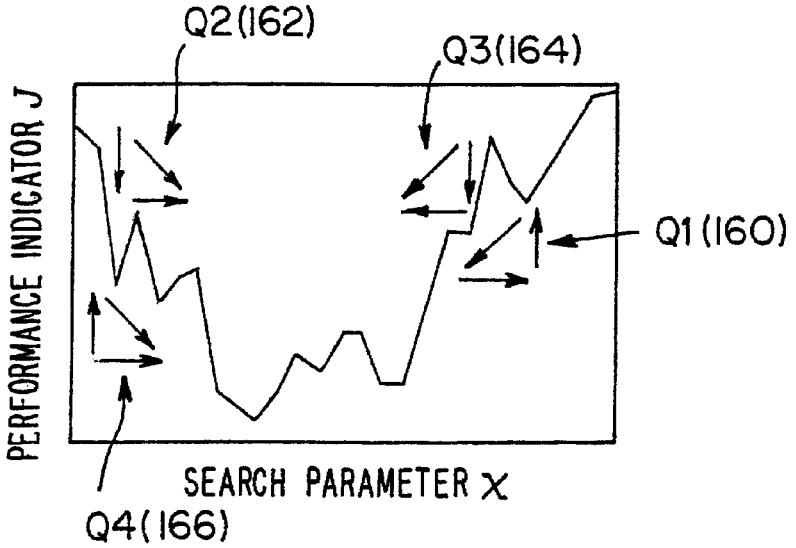
FIG. 11 shows the mapping of the fuzzy rule set of FIG. 9 to the minimization of the performance indicator.

With the specified input and the output membership functions, the nine generalized rules described above are used to develop a 49 entry fuzzy rule set. To model the gradient method, the rule set is illustrated in FIG. 9. In the fuzzy rule set of FIG. 9, if the center row and column are considered the zero axes, then the rule set can be reviewed as having four (4) quadrants: the $1^{st}$ quadrant 160 implements generalized rule 1; the $2^{nd}$ quadrant 162 implements generalized rule 2; the $3^{rd}$ quadrant 164 implements generalized rule 3; and, the $4^{th}$ quadrant 166 implements generalized rule 4. The center column 168 implements generalized rules 5 and 6. The center row 169 implements generalized rules 7 and 8. The origin 171, or crossing of the center column 168 and center row 169, implements generalized rule 9. In the four quadrants, the sign of the output linguistic values are appropriately chosen to generate adjustments of $\chi$ in the correct direction, and the output linguistic values are varied to generate variable adjustment magnitudes $\alpha$. This selection produces large adjustments in $\chi$ for activation of rules far from the origin 171 and small adjustments in $\chi$ for activation of rules near to the origin 171. The surface 170 for this rule set is illustrated in FIG. 10 and the mapping of the fuzzy rule set to the minimization of the performance indicator is illustrated in FIG. 11.

Implementation of the illustrated embodiment of the present application includes two optimizations. The first optimization is performed on the CD map setting $c_k$ and the second optimization is performed on the full-width performance setting $\beta$. Of course one or the other could be optimized alone in accordance with the present invention. The goal of the optimization is to minimize a performance indicator defined for the specific control setting.

Figure 12:
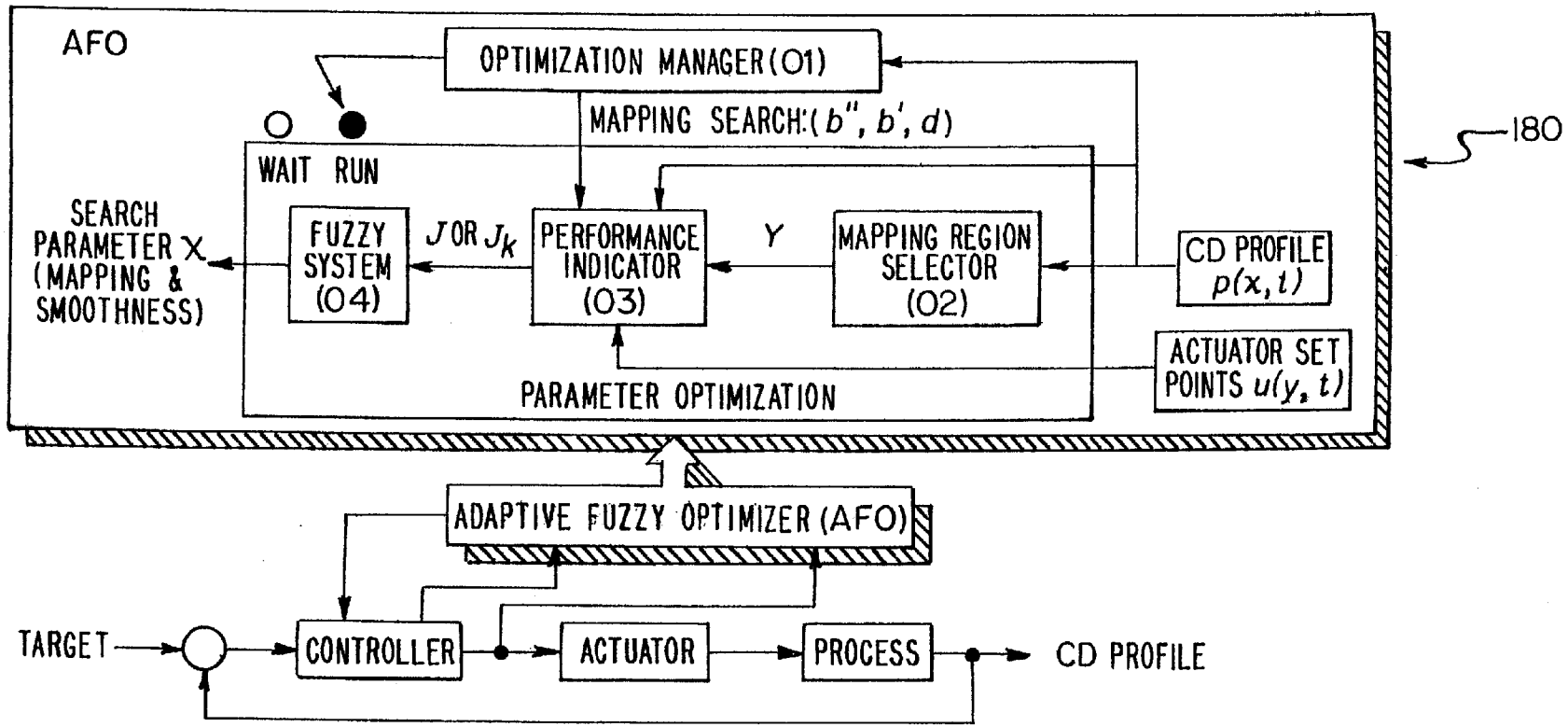
FIG. 12 is a block diagram illustrating key components of a sequence controller of a working embodiment of the present invention.

In a working embodiment of the invention of the present application, a sequence controller 180 manages the optimization searches. A block diagram illustrating the key components of the sequence controller 180 is illustrated in FIG. 12. The optimization manager 01 schedules execution of the mapping region selector 02, the performance indicator 03, and the fuzzy system 04.

The mapping region selector O2 evaluates the CD profile to reveal regions of the sheet that potentially need mapping improvements. The mapping optimization regions are selected in accordance with the definition of the ordered set of actuator indices Y. Of course, the present invention also permits manual selection of actuators for Y by bypassing execution of the mapping region selector O2. The selection of the ordered set Y is performed at initiation of the mapping optimization and the CD actuators in Y become the focus of the mapping optimization for obtaining a more effective alignment of the CD profile to the CD actuator array. Dependent on the subject of the optimization, either mapping or full-width performance, the performance indicator O3 computes the performance indicator, $J_k$ or J, and the fuzzy system O4 adjusts the appropriate control setting, $c_k$ or $\beta$, based on the fuzzy rule set illustrated in FIG. 9. The control setting, $c_k$ or $\beta$, is adjusted for a specified number of iterations. The performance indicator and fuzzy system O3 and O4 are executed on each of these iterations.

In addition to scheduling the execution of the mapping region selector O2, the performance indicator O3 and the fuzzy system O4, the optimization manager O1 of the sequence controller 180 oversees the operations of initiating the optimization process, selecting the CD map setting $c_k$'s to adjust, and terminating the optimization process.

Initiation of parameter optimization and adaptation is triggered either manually or automatically. For automatic triggering, the CD profile variability is continually monitored and compared against a triggering threshold. The optimization is automatically initiated for sustained profile variability in excess of the triggering threshold, for example when the standard deviation of the overall CD profile is greater than about 0.5% of the process target. Upon initiation, the current profile variability and control settings, $c_k$ and $\beta$, are saved as an initial reference for performance comparison and control setting restoration as needed.

Figure 13:
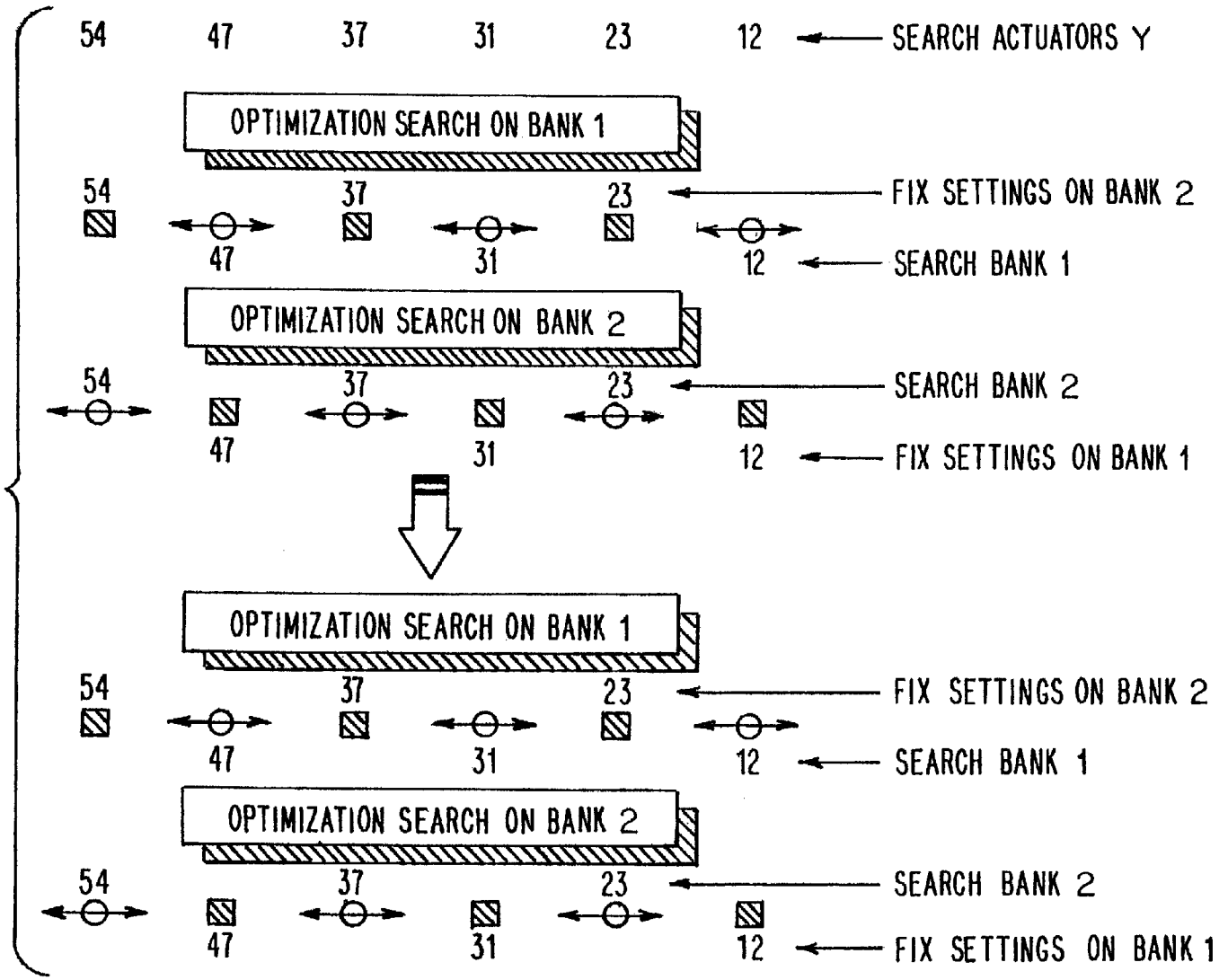
FIG. 13 illustrates execution of a multiple actuator optimization aspect of the present invention.

For CD mapping optimization, the optimization is performed at actuator locations y* specified in the actuator ordered set Y, see FIG. 3. Since mapping optimization is performed on multiple actuator $c_k$'s, a method of exercising multiple actuator mapping adjustments is employed to accelerate the optimization process and to substantially eliminate interaction between actuators involved in a search, i.e., search actuators. To this end, a multiple actuator optimization divides the actuators in Y into two alternating or interleaved banks. That is, consecutive actuators in the first bank are separated from one another by actuators in the second bank. The optimization is simultaneously performed for all actuators in one bank while holding the CD map setting $c_k$ of the actuators in the other bank fixed. The optimization of the $c_k$'s for a given bank is performed for the specified number of iterations, then the optimization is switched to the $c_k$'s for the alternate bank for the same number of iterations. Two separate adjustment iteration counts are specified. One iteration count specifies the number of adjustments performed on the actuator $c_k$ in each of the two banks and the other iteration count specifies the number of times the optimization alternates between the actuator banks. For example, if ten adjustment iterations are specified per bank of actuators and three iterations are specified for alternating between the actuator banks, ten adjustment iterations are performed on the actuators of the first bank while holding the second bank fixed, ten adjustment iterations are performed on the actuators of the second bank while holding the first bank fixed, ten adjustment iterations are conducted on the actuators of the first bank while holding the second bank fixed, etc. until thirty adjustment iterations have been performed on all actuators in Y. In this way, the mapping optimization is alternated between the two (2) banks. Execution of the multiple actuator optimization method is illustrated in FIG. 13.

Execution and termination of parameter optimization and adaptation can be triggered manually or automatically. Automatic termination of either the mapping or smoothness optimizations can be controlled using a variety of conditions, two exemplary conditions include: improvement of the profile variability by a specified percentage of the initial reference level; and, exhaustion of all adjustment iterations (or search tries) specified for the optimization as described above. To ensure that the control performance is being improved as much as possible during a given optimization operation, a series of CD profile improvement percentages (of the initial reference level) are selected to correspond to the control setting adjustment iterations. The improvement percentages are selected to have a decaying magnitude. That is, the improvement percentage required on the first adjustment iteration is larger than the improvement percentage required on the last adjustment iteration. For example, a 50% improvement may be required on the first adjustment iteration and a 20% improvement may be required on the last adjustment iteration. To further clarify, the improvement percentage for each subsequent iteration can be reduced by a factor $\alpha$ ($0 \leqq \alpha \leqq 1$, for example $\alpha$ equal to ½) times the difference between the current percentage and the final percentage. Hence, on the first iteration if the improvement percentage is 50%, on the second iteration the improvement percentage would be 35% (35=50−½ of (50−20)), on the third iteration the improvement percentage would be 27.5% (27.5=35−½ of (35−20)), etc. On any given iteration, if the CD profile variability is improved by the selected percentage, the optimization is terminated and the requested control setting, $c_k$ or $\beta$, adjustment is kept. If all specified adjustment iterations are exhausted with no significant improvement, the optimization is terminated and the control setting, $c_k$ or $\beta$, is restored to the initial reference value.

The automated optimization technique for CD control of the present application, as described above, results in a number of advantages. Some of which are as follows:

1. The automated optimization scheme removes a root cause of CD control performance deterioration. For CD control, the fundamental operation of mapping is essential for performance.

2. The present invention identifies profile regions having a high potential for improvement of the CD mapping. CD mapping is a functional means of describing a complex relationship between the CD profile and the CD actuator array. Local profile variation gives a performance measure of mapping for the CD actuator array.
3. The performance indicator of the present invention considers all the process variables that give a good measure of performance for adjusting and evaluating a control setting. The main objective of the present invention is minimization of the CD profile variability. Minimization of the CD control elements (actuator array) prevents unnecessary delivery of control actions to the process, which is likely to amplify CD profile variations in other spatial frequencies.
4. Uses a priori knowledge of the process and the control, and incorporates them into a fuzzy rule set.
5. The automated optimization technique is a complimentary function of the CD control system. The CD actuator mapping and full-width performance optimizations provide robustness to an existing CD control system by updating control settings of essential functions in a CD control system.
6. The automated optimization technique provides continuous monitoring and periodic execution of the control setting optimization and adaptation. The periodic execution is needed to handle the dynamic behavior of the sheet manufacturing process, which can change the CD mapping at any time. The sheet manufacturing process runs continuously, with periodic maintenance shutdowns. These shutdowns can span one month or longer, the periodic execution of control setting optimization is needed to compensate the CD control system for degradation in the production machinery.

The described optimization scheme of the present application provides hands-off and interruption free operation of a paper making machine. The continuous monitoring nature of the optimization method schedules the searching without manual intervention while permitting manual initiation if desired. The optimization search relies on operation of the CD control system to produce the performance of the search parameter so that operation of the CD control system is not interrupted or suspended during operation of the invention of the present application.

Having thus described the invention of the present application in detail and by reference to preferred embodiments thereof, it will be apparent that modifications and variations are possible without departing from the scope of the invention defined in the appended claims.

What is claimed is:

1. A method of optimizing a cross-machine direction (CD) control for a sheet making process, said method comprising the steps of:

establishing a CD control performance indicator representative of effectiveness of a CD control;

selecting CD control settings related to said CD control performance indicator;

searching for improved CD control settings which produce an improvement in said CD control performance; and utilizing said improved CD control settings which improve said CD control performance of said CD control.

2. A method as claimed in claim 1 wherein said step of selecting CD control settings comprises the step of determining mapping misalignment between at least one CD actuator and corresponding CD profile and said step of searching for improved CD control settings comprises the steps of:

changing a mapping alignment of said at least one CD actuator; and evaluating CD control performance.

3. A method as claimed in claim 2 wherein said step of establishing a CD control performance indicator representative of effectiveness of a CD control comprises the steps of:

calculating weighted quadratic sum of a band-passed CD profile segment corresponding to said at least one actuator;

calculating weighted quadratic sum of a band-passed CD setpoint array segment adjacent to said at least one actuator;

combining said weighted quadratic sum of a band-passed CD profile segment with said weighted quadratic sum of a band-passed CD setpoint array segment in a weighted sum in accordance with equation:

$$J_k(e_k,u_k,c_k)=e_k^TQ_k^TQ_ke_k+\lambda_ku_k^TR_k^TR_ku_k.$$

4. A method as claimed in claim 2 wherein said step of determining mapping misalignment between at least one CD actuator and corresponding CD profile comprises the steps of:

determining a CD profile for a web of material being manufactured by said sheet making process;

transforming said CD profile into a CD variance profile;

selecting highest variance locations within said CD variance profile; and mapping selected highest variance locations within said CD variance profile into said at least one CD actuator.

5. A method as claimed in claim 2 wherein said step of determining mapping misalignment between at least one CD actuator and corresponding CD profile comprises the step of determining mapping misalignment between a plurality of CD actuators and corresponding CD profile and said step of searching for improved CD control settings comprises the steps of:

changing mapping alignments of said plurality of CD actuators; and evaluating said CD control performance.

6. A method as claimed in claim 5 wherein said step of establishing CD control performance indicators representative of effectiveness of a CD control comprises the steps of:

calculating weighted quadratic sums of band-passed CD profile segments corresponding to said plurality of CD actuators;

calculating weighted quadratic sums of band-passed CD actuator setpoint array segments adjacent to said plurality of CD actuators; and combining said weighted quadratic sums of band-passed CD profile segments with said weighted quadratic sums of band-passed CD setpoint array segments in weighted sums in accordance with equation:

$$J_k(e_{kd},u_{kd},c_k)=e_{kd}^TQ_{kd}^TQ_{kd}e_{kd}+\lambda_{kd}u_{kd}^TR_{kd}^TR_{kd}u_{kd}.$$

7. A method as claimed in claim 5 wherein said step of determining mapping misalignment between a plurality of CD actuators and corresponding CD profile comprises the steps of:

determining a CD profile for a web of material being manufactured by said sheet making process;

transforming said CD profile into a CD variance profile;

selecting highest variance locations within said CD variance profile; and mapping selected highest variance locations within said CD variance profile into said plurality of CD actuators.

8. A method as claimed in claim 5 further comprising the steps of:

dividing said plurality of CD actuators into first and second groups, said first and second groups of CD actuators including alternating CD actuators so that consecutive CD actuators of said first group are separated by consecutive CD actuators of said second group;

said step of changing the mapping alignments of said plurality of CD actuators comprises the steps of:

simultaneously changing the mapping alignments of said first group of CD actuators while holding the mapping alignments of said second group of CD actuators fixed; and subsequently simultaneously changing the mapping alignments of said second group of CD actuators while holding the mapping alignments of said first group of CD actuators fixed.

9. A method as claimed in claim 2 wherein said step of selecting CD control settings further comprises the step of determining smoothness settings of actuator setpoints of said CD control and said step of searching for improved CD control settings further comprises the steps of:

changing said smoothness settings for said CD control; and evaluating CD control performance.

10. A method as claimed in claim 1 wherein said step of selecting CD control settings comprises the step of determining smoothness settings of actuator setpoints of said CD control and said step of searching for improved CD control settings comprises the steps of:

changing said smoothness settings for said CD control; and evaluating CD control performance.

11. A method as claimed in claim 1 wherein said step of establishing a CD control performance indicator representative of effectiveness of a CD control comprises the steps of:

calculating weighted quadratic sum of a band-passed CD profile;

calculating weighted quadratic sum of a band-passed CD setpoint array; and combining said weighted quadratic sum of a band-passed CD profile with said weighted quadratic sum of a band-passed CD setpoint array in a weighted sum in accordance with equation:

$$J(p,u,\beta)=p^TQ^TQp+\lambda u^TR^TRu.$$

12. A method as claimed in claim 1 wherein said step of searching for improved CD control settings which produce an improvement in said CD control performance comprises the step of using fuzzy logic to search for improved CD control settings.

13. A method as claimed in claim 12 wherein said step of using fuzzy logic comprises the steps of:

evaluating a change in said control performance indicator;

evaluating an actual change in control settings;

utilizing fuzzy rules selected to optimize said control performance indicator;

deriving an adjustment to said control settings; and requesting said adjustment be applied to the control settings.

14. A method as claimed in claim 1 wherein said step of searching for improved CD control settings comprises the steps of:

adjusting said CD control settings;

monitoring the CD control performance indicator of an adjusted CD control; and comparing the CD control performance indicators of said adjusted CD control to said CD control before adjustment to determine whether said adjustment resulted in improvement in said CD control performance indicator.

15. A method as claimed in claim 14 wherein said step of adjusting said CD control settings comprises iteratively adjusting said CD control settings, said method further comprising terminating adjustment of said CD control settings upon recognition of a termination condition.

16. A method as claimed in claim 15 further comprising the step of defining said termination condition as completion of a selected number of adjustment iterations.

17. A method as claimed in claim 16 further comprising the step of defining said termination condition as achievement of a selected improvement in said CD profile before adjustment.

18. A method as claimed in claim 1 wherein said method is initiated periodically, triggered eventfully, and/or started manually.

19. A method for cross-machine direction (CD) control for a sheet making process, said method comprising the steps of:

monitoring a CD profile of a sheet of material being manufactured;

determining whether said CD profile satisfies a desired CD profile;

determining current CD control settings;

if said CD profile does not satisfy said desired CD profile, searching for improved CD control settings which move said monitored CD profile toward said desired CD profile; and utilizing said improved CD control settings which move said monitored CD profile toward said desired CD profile.

20. A method as claimed in claim 19 wherein said step of determining whether said CD profile satisfies a desired CD profile comprises the steps of:

comparing said monitored CD profile to said desired CD profile;

indicating that said monitored CD profile satisfies said desired CD profile if said monitored CD profile is within specifications for said sheet of material; and indicating that said CD profile does not satisfy said desired CD profile if said monitored profile is not within said specifications.

21. Apparatus for cross-machine direction (CD) control for a sheet making machine, said apparatus comprising:

a sensor for monitoring a CD profile of sheet material being manufactured by said machine; and a controller programmed to perform the operations of:

determining whether said CD profile satisfies a desired CD profile;

determining current CD control settings;

if said CD profile does not satisfy said desired CD profile, searching for improved CD control settings which move said monitored CD profile toward said desired CD profile; and utilizing said improved CD control settings which move said monitored CD profile toward said desired CD profile.

22. Apparatus as claimed in claim 21 wherein said controller is programmed to determine whether said CD profile. satisfies a desired CD profile by performing the operations of:

comparing said monitored CD profile to said desired CD profile;

indicating that said monitored CD profile satisfies said desired CD profile if said monitored CD profile is within specifications for said sheet of material; and indicating that said CD profile does not satisfy said desired CD profile if said monitored profile is not within said specifications.

23. Apparatus as claimed in claim 22 wherein said controller is programmed to search for improved CD actuator settings by performing the operations of:

adjusting said CD control settings;

monitoring an adjusted CD profile; and comparing said adjusted CD profile to said CD profile before adjustment to determine whether said monitored CD profile moved toward said desired CD profile.

* * * * *